US006374474B1

(12) United States Patent
Rössler

(10) Patent No.: US 6,374,474 B1
(45) Date of Patent: Apr. 23, 2002

(54) DEVICE FOR SETTING TWO-PART FASTENERS

(75) Inventor: Andreas Rössler, Fernwald (DE)

(73) Assignee: Emhart LLC, Newark, DE (US)

( * ) Notice: Subject to any disclaimer, the term of this patent is extended or adjusted under 35 U.S.C. 154(b) by 47 days.

(21) Appl. No.: 09/642,288

(22) Filed: Aug. 18, 2000

(30) Foreign Application Priority Data

Aug. 18, 1999 (DE) ..... 199 39 016

(51) Int. Cl.[7] ..... B21J 15/34; B21P 31/00

(52) U.S. Cl. ..... 29/243.523; 29/243.525; 72/391.4; 72/391.6; 72/453.17

(58) Field of Search ..... 72/453.17, 453.19, 72/391.4, 391.6; 29/243.521, 243.523, 243.524, 243.525

(56) References Cited

U.S. PATENT DOCUMENTS 4,010,630 A * 3/1977 Davis, Jr. et al. ..... 72/391.4
4,027,520 A * 6/1977 Klein ..... 72/391.6
4,628,722 A * 12/1986 Mauer et al. ..... 72/391.6
4,630,460 A * 12/1986 Mauer ..... 72/391.6
4,903,522 A * 2/1990 Miller ..... 72/391.6
5,598,619 A * 2/1997 Rosier ..... 29/243.523
6,014,801 A * 1/2000 Wilcox ..... 29/243.525

* cited by examiner

*Primary Examiner*—David Jones
(74) *Attorney, Agent, or Firm*—Edward D. Murphy

(57) ABSTRACT

To set two-part fasteners (8), in particular blind rivets, in which for setting a first part (7) has to be pulled while a second part (6) is held, a device is proposed with a housing (1), a feed appliance (9) on the housing (1) to transfer a fastener (8) into the housing (1) through an orifice (12) in the housing (1), an abutment (3), which holds the second part (6) during the setting process, and a pulling device pulling the first part (7) during the setting process, which has a gripper (5) at an open end of a pulling element (4) which cooperates with a pulling piston (13) which is movable forwards and backwards along an axis of the housing (1) in a first chamber (14) by an actuating unit. To transfer a fastener (8) the pulling element (4) opens the orifice (12). The pulling element (4) extends through the piston (13). The pulling piston (13) and the pulling element (4) are movable relative to one another along the axis. The pulling element (4) has a piston (17) on the end opposed to the gripper (5). A second chamber (21) with variable volume is provided, limited by a casing (22), the piston (17) and the pulling piston (13). A third chamber (23) with variable volume is further provided, limited by a wall (24) and the piston (17).

20 Claims, 4 Drawing Sheets

DEVICE FOR SETTING TWO-PART FASTENERS

BACKGROUND OF THE INVENTION

The invention relates to a device for setting two-part fasteners, in particular blind rivets in which for setting a first part has to be pulled while a second part is held up, with a housing, a feed appliance on the housing to transfer a fastener into the housing through an orifice in the housing, an abutment which holds the second part during the setting process and a pulling device for pulling the first part during the setting process, the pulling device having a gripper at an open end of a pulling element which cooperates with a pulling piston which is movable forwards and backwards along an axis of the housing in a first chamber, wherein the pulling element opens the orifice to transfer a fastener.

Devices for setting two-part fasteners, in particular blind rivets, in which for setting a first part has to be pulled and a second part held, which devices have a housing, an abutment which holds the second part during the setting process, and a pulling device for pulling the first part during the setting process, which has a gripper at an open end of a pulling element which cooperates with a pulling piston which is movable forwards and backwards along an axis of the housing in the first chamber, are known. A device of this kind is described, for example, by EP 0 468 717. The feed of a two-part fastener is carried out manually in this device. Putting individual fasteners on to a device of this kind is relatively time-consuming. The use of a device of this kind is particularly disadvantageous for serial manufacture of products.

This problem has already been recognised. U.S. Pat. No. 4,628,722 describes a device for setting two-part fasteners, in particular blind rivets, in which for setting a first part has to be pulled and a second part held. The device has a housing and a feed appliance on the housing to transfer a fastener into the housing through an orifice in the housing. To achieve transfer of the fastener the pulling element has to be pulled back out of a setting position far enough to open the orifice.

The device has two pistons arranged behind one another, a pushing piston and a pulling piston, which are movable forwards and backwards along an axis in a common cylinder. The pushing piston is connected to a cylindrical pushing member. The pulling piston is connected to a cylindrical pulling element. The pulling element extends into the pushing member.

To set a fastener a pressure medium is introduced between the pushing piston and the pulling piston, so the two pistons move away from one another in opposing directions inside the cylinder. The pushing member herein exerts a pressure on the second part of the fastener, while the pulling element pulls on the first part of the fastener. After setting of the fastener has been carried out, a new fastener is put on the device.

For this purpose the pushing piston is impinged with a pressure medium, the pressure medium flowing out of the cylinder between the pistons, so the pushing piston is brought to rest against the pulling piston and the two pistons are driven into a final position in which the orifice is opened for the transfer of a fastener.

To position the two pistons for a further setting process the part of the chamber adjoining the pulling piston is put under pressure while the fluid with which the pushing piston has been impinged is pressed out of the cylinder by the movement of the two pistons. Once the two pistons have taken up a defined position inside the cylinder, the pressure medium is introduced between the pushing piston and the pulling piston, wherein the fluid acting on the pulling piston flows out of the part of the chamber adjoining the pulling piston.

Based on this, the object of the present invention is to develop further the known device for setting two-part fasteners, in particular blind rivets, in such a way that it is more simply designed in construction.

SUMMARY OF THE PRESENT INVENTION

The device according to the invention for setting two-part fasteners, in particular blind rivets, in which for setting a first part has to be pulled and a second part held, has a housing and a feed appliance arranged on the housing by which a fastener is transferred into the housing through an orifice in the housing. The device further has an abutment, which holds the second part of the fastener during the setting process and a pulling device pulling the first part of the fastener during the setting process, the pulling device having a gripper at an open end of a pulling element, which cooperates with a pulling piston which is movable forwards and backwards along an axis of the housing in a first chamber by means of an actuating unit, the pulling element opening the orifice for the transfer of a fastener. The device according to the invention is characterised in that the pulling element extends through the setting piston and the pulling piston and the pulling element are movable relative to one another along the axis, the pulling element has a piston at the end opposed to the pulling device, a second chamber with variable volume is provided, limited by a casing, the piston and the pulling piston, and a third chamber with variable volume is provided, limited by a wall and the piston. A compressible medium is provided in both the second and the third chamber with variable volume.

By means of this configuration of the device according to the invention it is achieved that it is more simply designed in construction. The device also enables easier assembly thereof, as relatively few parts are necessary to produce the device.

Reduction of the components of the device also brings an improved ability to handle the device, if it is a hand-actuated device. The ability to handle the device is also improved by the fact that the device is relatively light, so the person operating the device is prevented from becoming tired while using it.

During the setting process the pulling piston is displaced away from the abutment along the axis of the housing in the first chamber. Displacement of the setting piston is carried out by means of an actuating unit. The path by which the pulling piston is displaced in the direction of the second chamber with variable volume preferably corresponds to the path which is necessary for performing the actual setting process. With the movement of the pulling piston the pulling element, which has gripped the first part of the fastener with a gripper, exerts a tensile force on this first part. If this first part is a mandrel shank of a blind rivet, the pulling piston, and thus also the pulling element, is pulled in the direction of the second chamber with variable volume for sufficient time for the mandrel shank to break.

A further process follows the actual setting process, in which the pulling element is moved away from the abutment inside the housing sufficiently for the pulling element to open the orifice, through which a further fastener can be loaded into the housing. This opening is achieved in the device according to the invention as follows: during the setting process there is a compression of the medium present in the second chamber with variable volume, so the pressure inside the second chamber rises. This rise in pressure effects an increasing axially directed force on the piston, the direction of which corresponds to a tensile force, so the pulling element is further displaced axially. The volume of the third chamber is decreased because of the movement of the piston. This leads to a rise in pressure of the compressible medium present inside the third chamber. A force of pressure of the medium of the third chamber acts on the front face of the piston opposed to the pulling piston. This force of pressure is opposed to the force of pressure of the medium of the second chamber.

The piston can be axially displaced by the force of pressure of the medium of the second chamber until a balance of forces of the forces of pressure applied to the piston occurs. This is preferably the case when the orifice has been opened by the pulling element.

According to an advantageous design of the device it is proposed that the pulling element takes up a final position in which the orifice has been opened by the pulling element, which is determined by a buffer cooperating with the pulling element. With a configuration of the device of this kind it is not necessary to stop a balance of forces of pressure from occurring on the piston. It is therefore not absolutely necessary to adjust the geometry of the piston and/or the pressures prevailing in the chambers in such a way that a balance of forces prevails in the final position. It must, however, be ensured that a balance of forces does not occur before the pulling element has taken up its final position.

When the pulling piston is opened, there is a relaxation of pressure of the compressed media present in the second chamber, which effects a movement of the piston and thus also of the pulling element into the initial position. This movement takes set relatively quickly. The configuration according to the invention also has the advantage that there is no need for additional connections for compressed air or such-like, which are necessary with conventional devices to move the pulling element into the setting position. Independence of such connections is also achieved.

Based on the configuration of the device according to the invention the actuating unit is only required to produce a sufficient tensile force during the setting process.

The medium present by compression in the second chamber is used to open the orifice, through which a further fastener is loaded into the housing. To obtain a movement of the piston with the pulling element by means of the pressure of the medium present in the second chamber in the direction of the third chamber, it is proposed, according to an advantageous further development of the device according to the invention, that the diameter of the piston is greater than the diameter of the pulling element, so a substantially annular face is available as pressure face.

According to yet another further development of the device it is proposed that the diameter of the piston is smaller than the diameter of the setting piston.

The path which the pulling element covers, caused by the pressure prevailing in the second chamber, is dependent on, among other things, the volume of the third chamber. It is therefore proposed that the third chamber is formed by a partial chamber with variable volume and at least one partial chamber, fluidically connected to the partial chamber with variable volume, which has a constant volume of the chamber. In this way a relatively large volume is created, so the rise in pressure in the third chamber is relatively slight. A relatively large displacement path of the pulling element can be achieved with a relatively slight rise in pressure. This configuration of the device also has the advantage that the at least one partial chamber can be arranged in such a way that it is positioned in a region of the device in which the partial chamber does not interfere with the handling of the device. In particular it is also hereby achieved that two-part fasteners can also be set by the device in regions with edges in proximity to which a face normal of a workpiece wall bisects the longitudinal axis of the device at an angle, for example a right angle.

According to yet another advantageous configuration of the device it is proposed that the partial chamber with the constant volume of the chamber surrounds the partial chamber with the variable volume of the chamber. A further development of the device of this kind also has the advantage of achieving a relatively compact construction of the device.

According to yet another advantageous further development of the device it is proposed that the partial chambers are designed as substantially cylindrical, preferably the partial chambers are arranged concentrically to one another. The partial chambers can, for example, herein be designed in a cast part, in particular an injection-moulded part.

According to yet another advantageous development of the invention it is proposed that the partial chamber with variable volume is connected by at least one channel to the partial chamber which has a constant volume of the chamber, the at least one channel having at least one portion with a raised flow resistance. This further development of the device has the advantage that during the movement of the piston the medium does not overflow out of the partial chamber with variable volume into the chamber with a constant volume of the chamber all of a sudden, but slowly.

This has the advantage that, for example if the device is used for setting blind rivets, the energy of the pulling element and the piston released when the mandrel shank of the blind rivet breaks is partially converted into a task of compressing the medium in the partial chamber with variable volume, so the piston and the pulling element are cushioned by the medium present in the other partial chamber, a return kick of the piston and the pulling element being prevented by the over-flowing of the medium out of the first partial chamber into the second partial chamber.

The portion which forms an increased flow resistance can preferably be achieved by arranging a choke in the channel.

According to a further advantageous development of the device it is proposed that the portion is formed by a check valve. This design of the device enables a pressure to be set in the partial chambers, so the piston and therefore also the pulling element can be stopped depending on whether the check valve is closed.

According to yet another advantageous configuration of the device it is proposed that the partial chamber with variable volume is fluidically connected to the at least one partial chamber with a constant volume in such a way that the flow resistance for a flow out of the partial chamber with variable volume into the partial chamber with constant volume of the chamber is greater than for a flow out of the partial chamber with the constant volume of the chamber into the partial chamber with the variable volume. In other words, by means of this advantageous design of the invention it is achieved that the speed of the flow of a medium out of the chamber with the constant volume of the chamber is to be greater than the speed of the flow out of the partial chamber with variable volume into the partial chamber with the constant volume of the chamber. This configuration of the device has the advantage that on the one hand a slowing down of the piston and therefore of the pulling element during a movement into the final position is achieved and on the other hand the piston and the pulling element can be moved out of this final position into a setting position relatively quickly.

If the geometrical measurements of the chambers and the piston remain the same, the travel path of the pulling element is dependent on the difference in pressure of the media in the second and the third partial chamber. To set the displacement path of the pulling element it is therefore proposed that the second chamber and/or the third chamber has at least one valve through which a medium can be introduced into the second and third chamber.

This further development of the device also has the advantage that if there are leakages, (connected) to a loss of pressure in the second and/or third chamber, these can be balanced out by external sources of pressure which can be connected to the at least one valve. The provision of at least one valve in the second and/or third chamber also has the advantage that the device can be quasi biased in the second and third chamber by corresponding impingement of pressure, thus enabling pre-determined courses of movement of the pulling element.

According to yet another advantageous configuration of the device it is proposed that the second and the third chamber are connected by at least one valve in such a way that the medium can flow out of the third chamber into the second chamber when the pressure in the third chamber exceeds a pre-determined pressure value. This configuration is particularly advantageous if the seal between the second and the third chamber enables an overflow of the medium out of the second into the third chamber. By recycling the medium out of the third into the second chamber an equal volume of the medium is always guaranteed in the third chamber.

To convert this idea it is proposed that at least one valve is provided in the form of a check valve. Instead of a check valve the valve can also be provided in the form of a safety valve, which can be actuated, for example, electrically and/or magnetically.

The second and the third chamber are preferably filled with the same compressible medium, so certain leakages between the second and the third chamber are, to a certain extent, not felt to interfere. Such leakages can arise in devices which are used in particular for series production, after a plurality of movements of the pulling element and thus of the piston.

According to yet another advantageous further development of the device it is proposed that the actuating unit by which the pulling piston is moved is a unit operated by an electric motor. If necessary gears can be provided between the unit operated by an electric motor and the pulling piston.

According to yet another advantageous configuration of the device it is proposed that the actuating unit is a unit which acts hydraulically, wherein by this a medium under pressure can be introduced into it through at least one passage ending in the first chamber, so the pressure medium can act on the side of the pulling piston remote from the piston. The pressure medium is preferably a fluid, in particular an oil.

Further advantages and details of the invention are explained with reference to the embodiments illustrated in the drawings.

BRIEF DESCRIPTION OF THE ACCOMPANYING DRAWINGS

DETAILED DESCRIPTION OF THE PREFERRED EMBODIMENT

Figure 1:
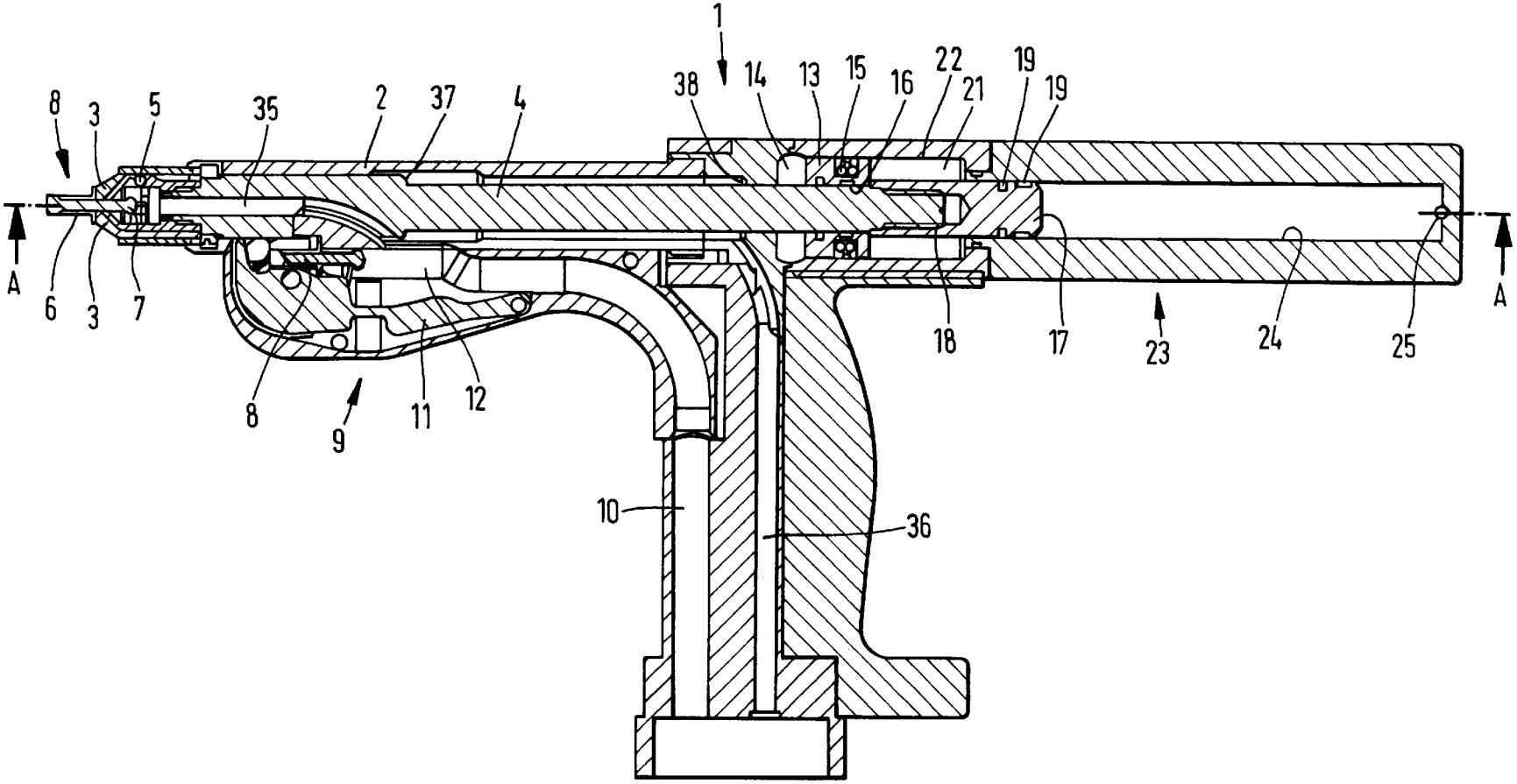
FIG. 1 shows schematically and in section a device for setting two-part fasteners.

FIG. 1 shows schematically and in section an embodiment of a device for setting two-part fasteners, in particular blind rivets, in which for setting one part has to be pressed and the other part pulled. The device is designed in the form of a hand-actuated device. It has a pistol-shaped housing 1. This has a tube-shaped front portion 2. The open end of the tube-shaped portion 2 has an abutment 3. Inside the housing 1 a pulling element 4 is arranged, which is movable forwards and backwards along an axis of the housing 1. A gripper 5 is arranged at an open end of the pulling element 4.

FIG. 1 illustrates how the abutment 3 rests on a second part 6 of a fastener 8. The first part 7 of the fastener 8 is gripped by the gripper 5. The fastener in the embodiment illustrated is a blind rivet. The device has a feed appliance 9 for the consecutive feed of individual fasteners. The feed appliance 9 is arranged on the housing 1. It comprises a feed channel 10 which ends in a transfer unit 11. A fastener 8 is transferred by the transfer unit 11 through an orifice 12 in the portion 2 of the housing 1 when the pulling element 4 with the gripper 5 has opened the orifice 12. The transfer unit 11 can advantageously be a transfer unit as known from EP 0 737 528 A1.

The pulling element 4 has a discharge channel 35 extending from one front face of the pulling element, which penetrates the face of the casing of the pulling element 4 after an arch-shaped portion. The end of the discharge channel 35 can be made to coincide with the end of a outlet 36 in a final position of the pulling element 4.

Remote from the gripper 5 the pulling element 4 has a surrounding collar 37. Inside the housing a projection 38 is provided which extends radially inwards in the direction of the pulling element 4. In a final position of the pulling element 4 the annular face of the collar 37 rests on the projection 38, so the movement of the pulling element 4 is limited by the collar 37 and the projection 38. The travel path of the pulling element 4 between its setting position, as illustrated in FIG. 1, and a final position, in which the pulling element 4 opens the orifice 12, is preferably 100 mm.

The pulling element 4 extends through a pulling piston 13. This is movable forwards and backwards along an axis of the housing in a first chamber 14. The pulling piston 13 has seals 15 on the surface of its outer casing, which serve to seal off the first chamber. The setting piston 13 is sealed off from the pulling element 4 by seals, not shown in FIG. 1, arranged in grooves 16.

The pulling element 4 has a piston 17 on the end opposed to the gripper 5. This is connected to the pulling element 4 in the embodiment illustrated by a threaded joint 18, the pulling element 4 having an outer thread at its end opposed to the gripper 5 and the piston 17 having an aperture with an inner thread. The piston 17 has grooves 19 on the surface of its outer casing, into which, for example, annular sealing elements can be inserted.

The device has an actuating unit, not shown. The actuating unit is a unit which acts hydraulically. The device has passages 20 which end in the first chamber 14, as can be seen from FIG. 2. Through these passages 20 a pressure medium coming from a pressure source which is not illustrated can be introduced into the first chamber 14, so the pressure medium can act on the side of the pulling piston 13 remote from the piston 17. The pressure medium is preferably an incompressible medium, in particular oil.

A second chamber 21 with variable volume is provided behind the first piston 14, limited by a casing 22, the piston 17 and the setting piston 13.

The piston 17 protrudes at least partially into a third chamber 23, with variable volume. The third chamber 23 is limited by a wall 24 and by the piston 17.

Figure 2:
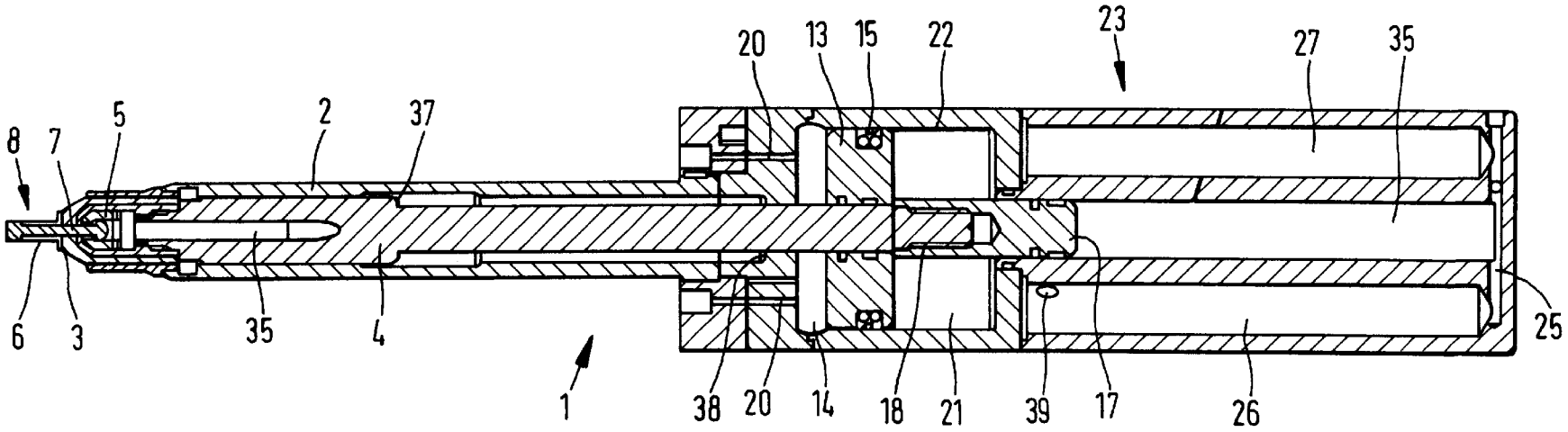
FIG. 2 shows the device according to FIG. 1 along the bisecting line A—A.

Referring to the illustration in FIG. 2, it can be seen that the third chamber 23 is formed by three partial chambers 26, 27 and 35. The third chamber 23 has a partial chamber 35 with variable volume, the volume of which is altered by the position of the piston 17. This partial chamber 35 with variable volume is fluidically connected to the partial chambers 26, 27, which each have a constant volume of the chamber. The partial chambers 35, 26, 27 are designed in the embodiment illustrated next to one another in a common housing.

The reference numeral 39 designates a connection, through which the third chamber 23, and thus also the partial chambers 26, 27, 35, can be impinged with a compressible medium. The connection 39 can be designed in the form of a valve. The partial chambers 26, 27, 35 are connected to one another by a channel 25, the channel 25 being arranged in an end portion of the third chamber 23. The channel 25 has a relatively small cross-section, so it forms a flow resistance.

An operating cycle of the embodiments illustrated in FIGS. 1 and 2 of a device according to the invention is described hereinafter.

The chamber 23 is filled through the connection 39 with a compressible medium, in particular with air. Inside the chamber 23 there is a pre-determined pressure, which is preferably around 6 bar when the chamber 23 has its maximum volume.

The second chamber 21 is also filled with a compressible medium, in particular air. The second chamber 21 has a connection, not illustrated, for this purpose. In the second chamber 21 there is also preferably a pressure of 6 bar.

The pulling element 4 is in a setting position, as illustrated in FIG. 1 and FIG. 2. In this setting position a second part 7 rests on the abutment 3. The first part 6 of the fastener 8 is gripped by a gripper 5. The passages 20 are connected to an actuating unit, not illustrated, which acts hydraulically. Sensors, not illustrated, verify that the pulling element is in its setting position and a fastener 8 has taken up a pre-determined position.

The actuating unit can be activated by a trigger mechanism, not illustrated. An oil under pressure, which, for example, is provided with a pressure of about 150 bar by the actuating unit, flows into the first chamber 14. The oil under pressure acts on the side of the piston 13 remote from in the piston 17. This pressure causes a force of pressure on the setting piston, so it is displaced in the direction of the second chamber 21. The piston 17 rests on the setting piston 13, so the pulling element connected to the piston 17 is moved with the movement of the setting piston 13 in the direction of the second chamber 21, so the pulling element 4 exerts a tensile force on the second part 7 via the gripper 5.

The volume of the second chamber 21 is decreased by the movement of the setting piston 13, causing a compression of the compressible medium inside the second chamber 21. Simultaneously the volume of the third chamber 23 is decreased, resulting in a rise in pressure inside the third chamber 23.

The medium under pressure in the second chamber 21 exerts a force of pressure on the annular front face of the pulling piston 17. This force of pressure is directed in the opposite direction to a force of pressure acting on the front face of the piston 17. If the fastener 8 is a blind rivet, this causes the first part 7 to break. This break occurs when the pulling piston 13 and therefore also the pulling element 4 have covered a break distance. This break distance corresponds to the displacement path of the pulling piston 13. Once the break of the first part 7 has occurred, there is no need for further feeding of the pressure medium into the first chamber 14. The remaining part of the first part 7 reaches an arch-shaped portion of the discharge channel 35 by means of a negative pressure prevailing in the discharge channel 35, and remains there.

The pressure inside the second chamber 21 has risen, because of the displacement of the pulling piston 13, so much that the force of pressure acting on the front face of the pulling piston 17, owing to the pressure in the second chamber 21, is greater than the force of pressure acting in the opposite direction owing to the medium in the third chamber. Because of this the piston 17 and also the pulling element 4 are displaced further away from the abutment 3 in a longitudinal direction. The pulling element 4 is displaced by the force of pressure until the collar 37 is resting on the projection 38, so the movement of the pulling element 4 and thus also of the piston 17 is completed. The pulling element 4 has reached its final position.

The whole path covered by the pulling element 4 is preferably 100 mm. The path covered by the pulling piston 13 is preferably 25 mm. 75 mm of the distance covered by the pulling element is derived from the force of pressure acting on the annular front face of the piston 17. In this final position there is preferably a pressure of about 7 bar in the third chamber.

In this final position the orifices of the discharge channel 35 and the outlet 36 overlap, so the remaining part of the first part 7 can be removed via the outlet 36. The orifice 12 has been opened, so a fastener can be transferred through the orifice 12 into the tube-shaped portion 2. Transfer by the feed appliance 9 can take set as in EP 0 737 528 A1. The final position of the pulling element is verified by a sensor, not illustrated. At least one further sensor establishes whether the remaining part of the second part 7 has been removed from the discharge channel 35.

If there is a further fastener 8 in the feed appliance 9 ready for transfer to the pulling element 4 and if the further marginal conditions have been met, the pressure inside the first chamber is reduced by a control device. This reduction of the pressure inside the first chamber 14 leads to an expansion of the medium inside the second chamber 21, whereby the pulling piston 13 is driven into its initial position. Simultaneously there is an expansion of the medium inside the third chamber 23, so the pulling element 4 is driven into the setting position, resulting during this movement in a take-up of the fastener 8 protruding into the travel path of the pulling element 4.

The movement of the pulling element 4 out of the final position into the setting position takes place relatively quickly, as a relatively small volume of the pressure medium has to be drawn off from the first chamber 14.

Figure 3:
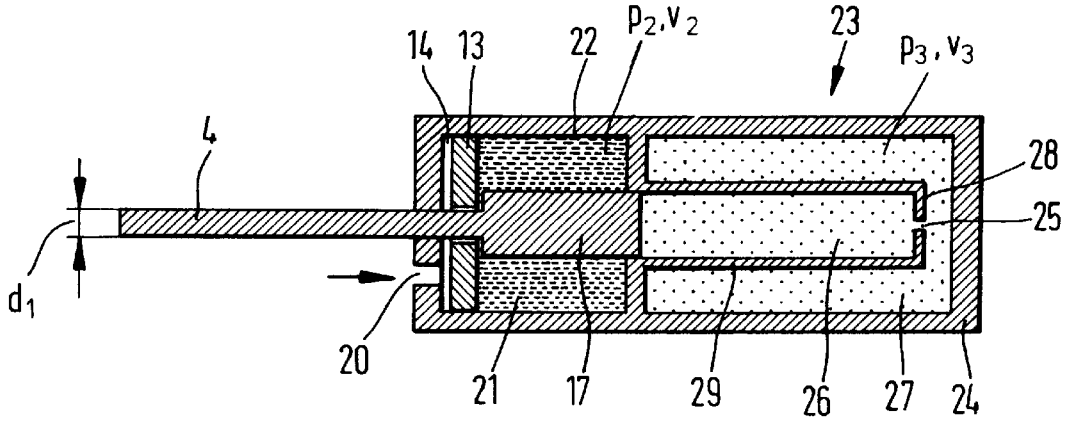
FIG. 3 shows schematically an embodiment of the pulling device of the device for setting two-part fasteners in an initial position.

FIG. 3 shows schematically and in section a further embodiment of a pulling device of a device for setting two-part fasteners.

The pulling device comprises a pulling piston 13, arranged in a first chamber 14. A pulling element 4 extends through the pulling piston 14. The pulling element 4 has a substantially circular cross-section. One end of the pulling element 4 is provided with a piston 17. The pulling piston 13 and the piston 17 are movable relatively to one another along an axis of a housing. The first chamber 14 has a passage 20. Through this a pressure medium under pressure can act on the side of the pulling piston 13 remote from the piston 17. The flow direction of the pressure medium is indicated by the arrow in the passage 20 in FIG. 3.

A second chamber 21 with variable volume is provided behind the pulling piston 13. This is limited by a casing 22, the pulling piston 13 and the piston 17. A compressible medium, preferably air, is contained inside the second chamber 21 with variable volume.

The pulling device according to FIG. 3 has a third chamber 23 with variable volume. The third chamber 23 comprises a partial chamber 26 with variable volume, limited by a wall 24 and the piston 17. A partial chamber 27 with a constant volume of the chamber is further provided.

The partial chamber 26 with variable volume is substantially sheath-shaped. The piston 17 is movable in this along an axis. The inner contours of the partial chamber 26 are adapted to the outer contours of the piston 17. Preferably the piston 17 and the partial chamber 26 have a circular cross-section. In a front wall 28 of the partial chamber wall 29 a channel 25 is designed, through which the two partial chambers 26, 27 are fluidically connected to one another. The diameter of the channel 25 is preferably relatively small, so the channel forms a flow resistance.

An operating cycle of the device according to the invention according to FIG. 3 can best be looked starting with the pulling element 4 in a setting position, as illustrated in FIG. 3.

When the pulling element 4 is in its setting position, one part 6 of a fastener 8 rests on a buffer shoulder 3. The other part 7 of the fastener 8 is gripped by a gripper 5.

The first chamber 14 has not yet been impinged with a pressure medium. In the second chamber 21 there is a prevailing pressure $p_2$. The second chamber 21 has a volume $V_2$. In the third chamber 23 there is a pre-determined prevailing pressure $p_3$. The third chamber 23 has a volume $V_3$.

The piston 17 rests partially on this with its front face adjacent to the pulling piston 13.

By means of a trigger mechanism, not shown, a pressure source is activated, out of which a pressure medium flows through the passage 20 into the first chamber 14. The pulling piston 13 is moved together with the piston 17 in the direction of the third chamber 23 by the pressure medium. With this movement of the pulling piston 13 the volume of the second chamber 21 is reduced. The reduction of the volume of the second chamber 21 leads, on the assumption that the change in volume takes place isothermically and the medium present in the second chamber 21 behaves like an ideal gas, to a rise in pressure directly proportional to the change in volume of the second chamber.

Figure 4:
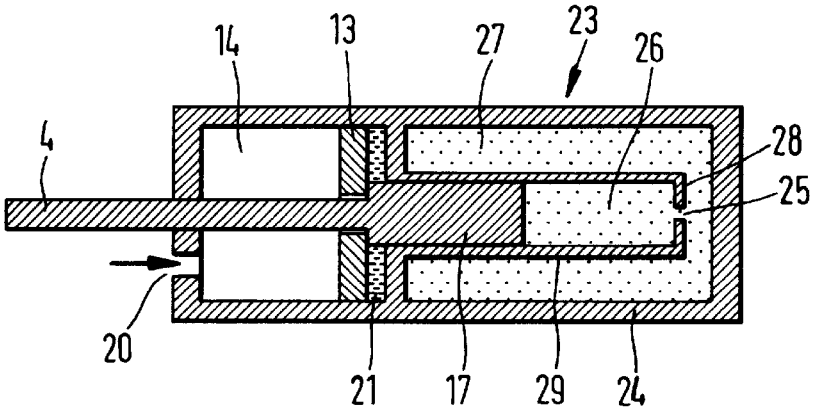
FIG. 4 shows the pulling device according to FIG. 3 in an intermediate position during a setting process.

The movement of the piston 17 leads to a reduction of the volume of the third chamber, as the piston 17 reaches the inside of the first partial chamber, as illustrated in FIG. 4. FIG. 4 shows an intermediate state during the setting process.

When the pulling piston 13 has reached a buffer 30, the pulling piston 13 has covered a path distance $I_1$. If the fastener 8 is a blind rivet the path distance $I_1$ preferably corresponds to the path the pulling element 4 has to cover to achieve a break in the mandrel shank after forming a locking head of the blind rivet.

The movement of the pulling piston 13 and the piston 17 leads to a compression of the medium both in the second 21 and in the third chamber 23. Owing to the compression of the medium in the second chamber 21 the pressure affecting the front face of the piston 17 rises, so the force in an axial direction, acting on this front face, also rises.

Figure 5:
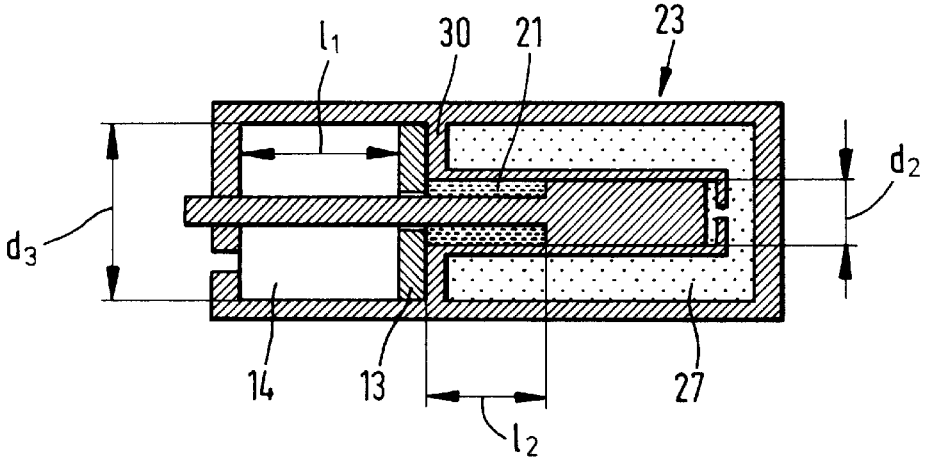
FIG. 5 shows the pulling device according to FIG. 3 in a final position in which the pulling element opens an orifice in the housing of the device.

A force acts against this force, acting on the open front face of the piston by means of the pressure inside the third chamber 23. A displacement of the piston 17 in an axial direction is completed when the forces acting in an opposite direction are the same. FIG. 5 shows this state. The piston 17 is displaced by the distance 12, and thus also the pulling element 4, along the axis, the total displacement $(I_1+I_2)$ being sufficiently large to open the orifice 12.

The movement of the piston 17 and thus also of the pulling element 14 can also be completed by providing a corresponding buffer, by which the pulling element is limited in its axial movement, as is the case in a pulling element according to FIG. 1.

It is also not necessary for the piston 13 to be driven as far as a shoulder 30. The travel path of the piston 13 is also dependent on the pressure of the pressure medium introduced into the first chamber 14 through the passage 20.

For the actual setting process, in configuring the device it is only necessary to impinge the setting piston 13 with a pressure medium for the actual setting process. Further displacement of the pulling element 4 is achieved by the compression of the medium in the second chamber 21.

The pressure inside the first chamber 14 can be maintained until a fastener has been transferred into the housing by the feed appliance. If the pressure inside the first chamber 14 is reduced, this leads to a volume expansion of the medium taking place in the second chamber 21. If the force of pressure exerted by the medium of the second chamber on the setting piston 13 is greater than the force of pressure of the pressure medium in the first chamber, the setting piston 13 is driven into its initial position.

The pulling element 4 and the piston 17 stay in their final position as long as the force of pressure exerted by the medium of the second chamber 21 on the piston 17 is greater than the force of pressure exerted by the medium in the third chamber 23 on the piston 17. If the force of pressure exerted by the medium of the second chamber on the front face of the piston 17 drops below the force of pressure exerted by the medium of the third chamber on the piston 17, the piston 17 is displaced into its initial position, until, if necessary, a new balance of forces occurs. The occurrence of this balance of forces can be set depending on the course of pressure of the pressure medium in the first chamber 14. It is therefore possible to control or regulate the movement of the pulling element 4 into its initial position depending on pressure in the first chamber. This also applies to the movement of the pulling element 4 out of its setting position into the final position.

If the first chamber 14 is made substantially pressure-less, the setting piston 13 and the pulling element 4 with the piston 17 take up the initial positions illustrated in FIG. 3. A new operating cycle can be started.

Figure 6:
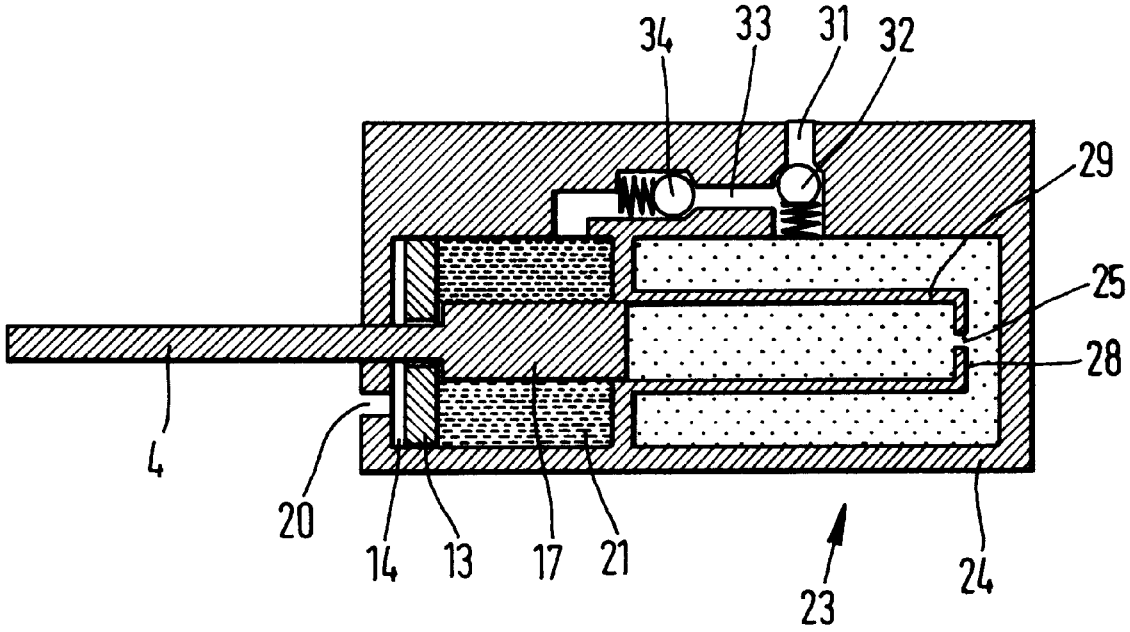
FIG. 6 shows schematically a further embodiment of a pulling device of a device for setting two-part fasteners.

FIG. 6 shows yet another embodiment of a pulling device for a device for setting two-part fasteners. The basic construction of this feed appliance corresponds to the construction of the appliance illustrated in FIG. 3. The modification of the feed appliance according to FIG. 6 can also be performed in a corresponding manner on a pulling device of the device as illustrated in FIG. 1.

The pulling device according to FIG. 6 has a through-channel 31 which extends through the wall 24 and ends in the third chamber 23. The end of the through-channel 31 opposed to the third chamber 23 is provided with connecting means, not illustrated, by which the through-channel 31 can be connected to a source of pressure, not illustrated.

A valve 32 is arranged inside the through-channel 31. The valve 32 is so designed that a medium can flow from a source of pressure, not illustrated, through the through-channel 31 into the third chamber 23. In the embodiment illustrated it is a check valve. Other kinds of valves can be provided instead of the check valve.

Because of the ability to connect the source of pressure, the pressure of the medium inside the third chamber 23 can be set at a pre-determined value. Preferably the pressure inside the third chamber, filled with air, is 6 bar when the third chamber 23 has its maximum volume.

A connecting channel 33 ends with one end in the second chamber 21. The other end of the connecting channel 33 ends in a portion of the through-channel 32, which is situated between the valve 31 and the third chamber 23, so even when the valve 32 is closed a fluidic connection is possible between the second chamber 21 and the third chamber 23.

A valve 34 is arranged inside the connecting channel 33, which allows the medium to flow into the second chamber 21. The valve 34 is a check valve in the embodiment illustrated. Other valves are possible.

If a source of pressure is connected to the through-channel 31 and a medium is provided at a sufficiently high pressure in the through-channel 31, the valve 32 opens the through-channel 31, so the medium can flow into the third chamber 23 and into the connecting channel 33. If the pressure of the medium in the connecting channel 33 is greater than the pressure in the second chamber 21, the valve 34 opens and the medium reaches into the second chamber 21 until the pressure is balanced out. In the initial position of the components the pressure is the same in the second chamber 21 as in the third chamber 23.

The embodiment of the pulling device illustrated in FIG. 6 for a device for setting two-part fasteners also opens up the possibility of limiting the rise in pressure in the third chamber during the compression process depending on the way the valve 34 is switched. If, owing to the decrease in volume inside the third chamber, the pressure has exceeded a pre-determined threshold value, which is higher than the pressure in the second chamber 21, the valve 34 opens the connecting channel 32, so the medium can flow out of the third chamber 23 into the second chamber 21, until the pressure in the third chamber 23 drops below the pre-determined threshold value.

This configuration and operating mode of the device is particularly advantageous if, owing to leakages, a medium, though having reached the third chamber 23 from the second chamber 21, cannot flow back from it.

The valve 34 can also be of such a kind that it always enables a balance of pressure between the third chamber 23 and the second chamber 21 during a compression process of the medium in the second chamber 21 and in the third chamber 23. This method of procedure is especially advantageous if leakages occur, so the medium flows out of the second chamber 21 into the third chamber 23. By this measure the availability of the device can be increased. While the pressure on the media in the second 21 and the third chamber 23 is being relaxed, preferably no pressure balance takes place between the two chambers through the connecting channel 32.

What is claimed is:

1. A device for setting two-part fasteners (8), in particular blind rivets, in which for setting a first part (7) has to be pulled and a second part (6) held comprising:

a housing (1), a feed appliance (9) on the housing (1), to transfer a fastener (8) into the housing (1) through an orifice (12) in the housing (1), an abutment (3) which holds the second part (6) during the setting process, and with a pulling device pulling the first part (7) during the setting process, said device having a gripper (5) at an open end of a pulling element (4) which cooperates with a pulling piston (13) which is movable forwards and backwards along an axis of the housing (1) in a first chamber (14) by means of an actuating unit, said pulling element (4) opens the orifice (12) to transfer a fastener (8), characterised in that the pulling element (4) extending through the pulling piston (13) and the pulling piston (13) and the pulling element (4) are movable relative to one another along the axis, the pulling element (4) has a piston (17) on the end opposed to the gripper (5), a second chamber (21) with variable volume is provided, limited by a casing (22), the piston (17) and the pulling piston (13) and a third chamber (23) with variable volume, limited by a wall (24) and the piston (17).

2. A device according to claim 1, characterised in that the diameter (d2) of the piston (17) is greater than the diameter (d1) of the pulling element (4).

3. A device according to claim 1, characterised in that the diameter (d2) of the piston (17) is smaller than the diameter (d3) of the pulling piston (13).

4. A device according to claim 1, 2 or 3, characterised in that the third chamber (23) is formed by a partial chamber (26) with variable volume and by at least one partial chamber (27, 35), fluidically connected to it, with a constant volume of the chamber.

5. A device according to claim 4, characterised in that the partial chamber (27) with the constant volume of the chamber surrounds the partial chamber (26) with the variable volume of the chamber.

6. A device according to claim 4, characterised in that the partial chambers (26, 27) are substantially designed as cylindrical.

7. A device according to claim 6, characterised in that the partial chambers (26, 27) are arranged as concentric to one another.

8. A device according to claim 4, characterised in that the partial chamber (26) with variable volume is connected by at least one channel (25) to a partial chamber (27, 35), the at least one channel (25) having at least one portion with a raised flow resistance.

9. A device according to claim 8, characterised in that the portion is formed by a by a choke.

10. A device according to claim 8, characterised in that the portion is formed by a control valve.

11. A device according to claim 4, characterised in that the partial chamber (26) with variable volume and is fluidically connected to the at least one partial chamber (27, 35) with a constant volume in such a way that the flow resistance for a flow out of the partial chamber (26) with variable volume into the partial chamber (27, 35) with the constant volume of the chamber is greater than for a flow out of the partial chamber (27, 35) with the constant volume of the chamber into the partial chamber (26) with the variable volume.

12. A device according to claim 1, characterised in that the second chamber (21) and/or the third chamber (23) has at least one valve (32, 34), by which a medium can be introduced into the second and third chamber (21, 23).

13. A device according to claim 1, characterised in that the second and the third chamber (21, 23) are connected by at least one valve (34) in such a way that the medium can flow out of the third chamber (23) into the second chamber (21) when the pressure in the third chamber (23) exceeds a pre-determined pressure value.

14. A device according to claim 12, characterised in that at least one valve (32, 34) is a check valve.

15. A device according to claim 12, characterised in that at least one valve (32, 34) is a safety valve.

16. A device according to claim 4, characterised in that the medium is a gas, in particular air.

17. A device according to claim 1, characterised in that the actuating unit is a unit operated by an electric motor and connected to the pulling piston (13).

18. A device according to claim 1, characterised in that the actuating unit is a unit acting hydraulically, wherein by this a pressure medium under pressure can be introduced into the first chamber (14) through at least one passage (20) ending in the first chamber (14), so the pressure medium can act on the side of the pulling piston (13) remote from the piston (17).

19. A device according to claim 18, characterised in that the pressure medium is a fluid, in particular an oil.

20. A device according to claim 1, characterised in that the pulling element (4) takes up a final position, in which the orifice (12) is opened by the pulling element (4) and which is determined by a buffer cooperating with the pulling element (4).

* * * * *